US007183874B2

(12) United States Patent
Satoh et al.

(10) Patent No.: US 7,183,874 B2
(45) Date of Patent: Feb. 27, 2007

(54) CASING CONTAINED FILTER

(75) Inventors: Kei Satoh, Yokosuka (JP); Shoichi Narahashi, Yokohama (JP); Tetsuo Hirota, Kanazawa (JP); Yasushi Yamao, Yokosuka (JP)

(73) Assignee: NTT DoCoMo. Inc., Tokyo (JP)

( * ) Notice: Subject to any disclaimer, the term of this patent is extended or adjusted under 35 U.S.C. 154(b) by 67 days.

(21) Appl. No.: 11/046,885

(22) Filed: Feb. 1, 2005

(65) Prior Publication Data

US 2005/0184826 A1 Aug. 25, 2005

(30) Foreign Application Priority Data

Feb. 3, 2004 (JP) ..... 2004-027188

(51) Int. Cl.
*H01P 1/04* (2006.01)

(52) U.S. Cl. ..... 333/99 S; 505/210

(58) Field of Classification Search ..... 333/99 S, 333/239; 505/210, 701, 866
See application file for complete search history.

(56) References Cited

U.S. PATENT DOCUMENTS 2,363,464 A * 11/1944 Senkus ..... 564/495

(Continued)

FOREIGN PATENT DOCUMENTS

| | | |
|---|---|---|
| EP | 0 496 512 A1 | 7/1992 |
| EP | 1 160 910 A1 | 12/2001 |
| FR | 2 261 656 | 9/1975 |
| JP | 2001-77604 | 3/2001 |

OTHER PUBLICATIONS

Hideyuki Suzuki, et al., "A Low-Loss 5 GHz Bandpass Filter Using HTS Quarter-Wavelength Coplanar Waveguide Resonators", IEICE Trans. Electron., vol. E-85-C, No. 3, Mar. 2002, pp. 714-719.

*Primary Examiner*—Robert Pascal
*Assistant Examiner*—Kimberly E Glenn
(74) *Attorney, Agent, or Firm*—Oblon, Spivak, McClelland, Maier & Neustadt, P.C.

(57) ABSTRACT

A filter is provided which maintains a low insertion loss characteristic of a filter contained in a casing with a very simple construction that the internal wall of the casing is formed by a superconductor. A coplanar waveguide filter 22 comprises a dielectric substrate 1, a plurality of resonators 5*a*, 5*b*, 5*c* and 5*d* and input/output terminal sections 4*a* and 4*b*, each of which is formed by a center conductor 2 and ground conductors 3*a* and 3*b*, both formed on the same surface of the dielectric substrate 1, with the ground conductors 3*a* to 3*d* being formed on the opposite sides of and in parallel relationship with the center conductor 2. The filter 22 is contained within a casing 21 having an internal wall, the surface of which is formed with a layer of superconductor 23. By way of example, a high temperature superconductor such as lanthanum-, yttrium-, bismuth- or thallium-superconductor is deposited as a film on a substrate of a metal oxide material such as MgO, $SrTiO_3$, $LaGaO_3$, $LaAlO_3$ to provide a superconductor filmed substrate 25, which is applied to the internal surface of the casing 21. Electromagnetic power which is irradiated from the filter 22 does not produce a power loss when it impinges on the layer of superconductor 23 in its superconducting state, but is reflected therefrom to be absorbed by the filter 22, thus reducing the filter insertion loss.

5 Claims, 14 Drawing Sheets

U.S. PATENT DOCUMENTS 4,918,049 A 4/1990 Cohn et al.
5,215,959 A * 6/1993 Van Duzer ..... 505/201
5,750,473 A 5/1998 Shen
5,770,987 A 6/1998 Henderson

* cited by examiner

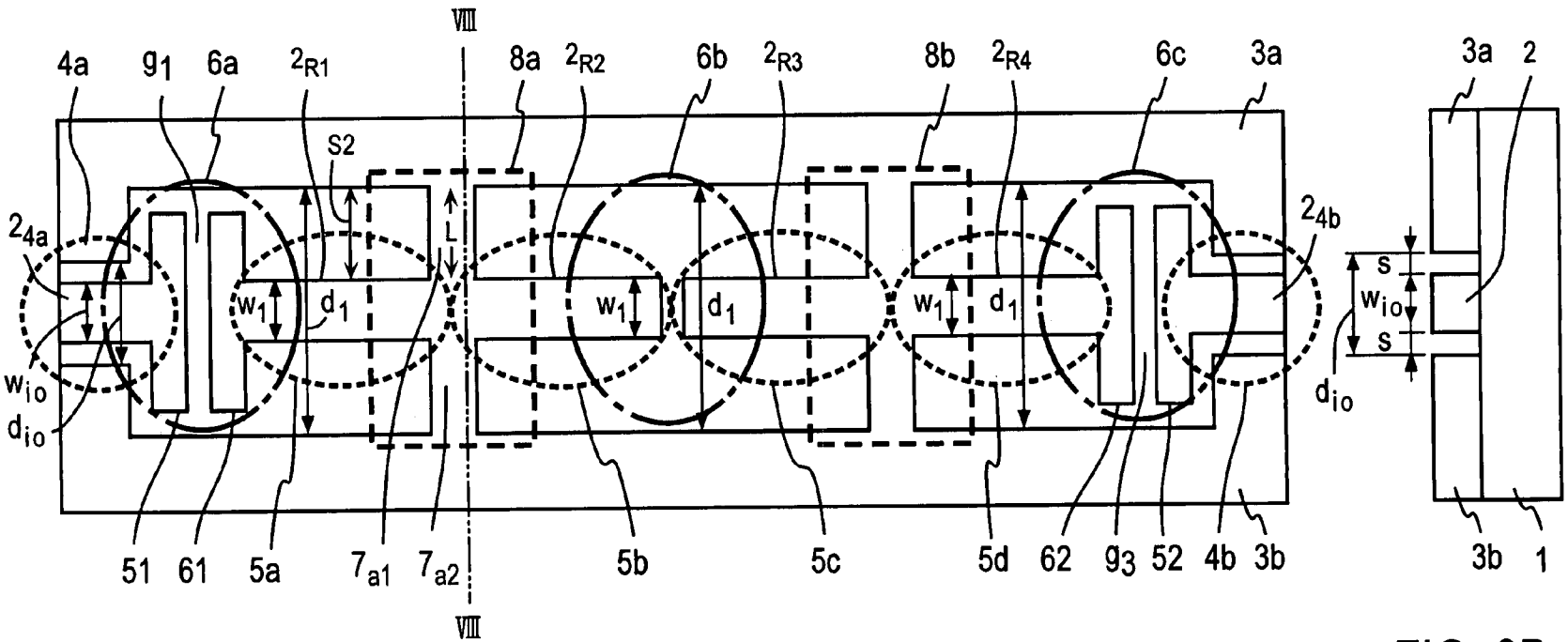
FIG. 6B
FIG. 6A
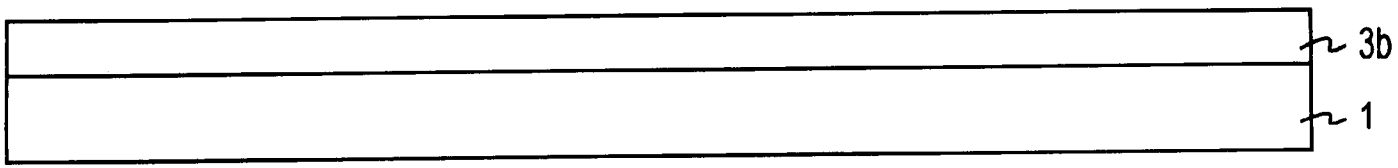
FIG. 6C

CASING CONTAINED FILTER

BACKGROUND OF THE INVENTION

The present invention relates to a filter which is used in a selective separation of signals in a particular frequency band in the field of a mobile communication, a satellite communication, a fixed microwave communication and other communication technologies, for example, and in particular, to such a filter which is contained in a metal casing.

Recently, a filter which uses a superconductor is proposed as a filter which is used in the separation of signals in the transmission and reception of a microwave communication, and a variety of constructions are used to construct such a filter including a cavity resonator construction, a microstrip line construction, a coplanar line construction in a flat sheet circuit configuration or the like.

The concept of a coplanar line will be described with reference to FIG. 1. In FIG. 1, formed on a dielectric substrate 1 are a ribbon-like center conductor 2, and a first and a second ground conductor 3*a* and 3*b* which are equally spaced from the center conductor 2 on the opposite sides thereof. The three members including the center conductor 2, the first and the second conductor 3*a* and 3*b* are formed parallel to and coplanar with each other on the common surface of the dielectric substrate 1. The coplanar line has features that no via-holes are required in forming a one-quarter wavelength resonator, a miniaturization is possible without changing a characteristic impedance and that a greater freedom of design is available. Denoting the width of the center conductor 2 by w and the spacing between the center conductor 2 and each of the first and the second ground conductors 3*a* and 3*b* by s, the coplanar line has a characteristic impedance which is determined by the line width w of the center conductor and the spacing d(w+2s) between the first and the second ground conductor 3*a* and 3*b*.

Referring to FIGS. 2A to 2C, a conventional example of the coplanar waveguide filter will be described. This example is what is disclosed in a literature: H. Suzuki, Z. Ma, Y. Kobayashi, K. Satoh, S. Narahashi and T. Nojima, "A low-loss 5 GHz bandpass filter using HTS quarter-wavelength coplanar waveguide resonators", IEICE Trans. Electron., vol. E-85-C, No. 3, pp714–719, March 2002. In this example, a first to a fourth resonator 5*a* to 5*d* are disposed on a line. Each resonator comprises a center conductor 2 having an electrical length equivalent to one-quarter wavelength and a first and a second ground conductor 3*a* and 3*b* disposed on the opposite sides of and parallel to the center conductor 2 and spaced therefrom by a spacing s, which are formed on the common surface of a dielectric substrate 1.

A first input/output terminal section 4*a* of a coplanar line type to which a signal is input is capacitively coupled to the first resonator 5*a*. In the example shown, one end of a center conductor $\mathbf{2}_{4a}$ of the first input/output terminal section 4*a* and one end of a center conductor $\mathbf{2}_{R1}$ of the first resonator 5*a* are disposed in mating relationship with each other in the manner of comb teeth and spaced by a gap g1 in order to strengthen the capacitive coupling, thus forming a first capacitive coupler 6*a*. The other end of the center conductor $\mathbf{2}_{R1}$ and one end of a center conductor $\mathbf{2}_{R2}$ of a second resonator 5*b* are connected together by shorting line conductors 7*a*1 and 7*a*2, which are in turn connected to the first and the second ground conductor 3*a* and 3*b*, respectively, thus forming a first inductive coupler 8*a* between the first and the second resonator 5*a* and 5*b*.

Cuts 20 are formed into the first and the second ground conductor 3*a* and 3*b* on each side of the shorting line conductors 7*a*1 and 7*a*2, whereby the shorting line conductors 7*a* are apparently extended, increasing the degree of coupling of the first inductive coupler 8*a*. A gap g2 is provided between the other end of the center conductor $\mathbf{2}_{R2}$ of the second resonator 5*b* and one end of a center conductor $\mathbf{2}_{R3}$ of a third resonator 5*c*, whereby the second and the third resonator 5*b* and 5*c* are coupled together by a second capacitive coupler 6*b*.

The other end of the center conductor $\mathbf{2}_{R3}$ and one end of a center conductor $\mathbf{2}_{R4}$ of a fourth resonator 5*d* are connected together by shorting line conductors 7*b*1 and 7*b*2 and connected to the ground connectors 3*a* and 3*b* through these shorting line conductors 7*b*1 and 7*b*2, whereby the third and the fourth resonator 5*c* and 5*d* are coupled together by a second inductive coupler 8*b*. In the second inductive coupler 8*b*, also cuts 21 are formed into the ground conductors 3*a* and 3*b*

The fourth resonator 5*d* and a second input/output terminal section 4*b* are capacitively coupled. Specifically, the other end of the center conductor $\mathbf{2}_{R4}$ and a center conductor $\mathbf{2}_{4a}$ of the second input/output terminal section 4*b* are formed in the configuration of meshing comb teeth and disposed in opposing relationship and spaced apart by a gap g3, thus forming a third capacitive coupler 6*c* which provides a strong coupling therebetween.

In order to reduce a loss caused by an irradiation of electromagnetic power from the filter which defines a coplanar waveguide filter, it is contained in a square tubular metal casing 10 as shown in FIG. 3, for example, allowing the electromagnetic power which is irradiated from the coplanar waveguide filter to be recovered by the filter again. The coplanar waveguide filter 11 is disposed in opposing relationship and parallel to one side plate of the metal casing 10, and the internal space of the metal casing is substantially halved by the coplanar waveguide filter 11. The electromagnetic power which is irradiated from the coplanar waveguide filter 11 is reflected by the internal surface of the metal casing 10 substantially in its entirety and a majority of the irradiated electromagnetic power is recovered by the filter 11, thus alleviating a radiation loss.

In a conventional filter which is confined within a metal casing, the electromagnetic power which is irradiated from the filter contained in the metal casing is reflected by the internal surface of the metal casing, and the majority of the electromagnetic power is recovered by the filter. However, a potion of electromagnetic power which is irradiated from the filter becomes an induced current which follows through the metal on the internal surface of the metal casing 10, presenting a problem of radiation loss. This problem is not limited to a coplanar waveguide filter, but also occurs in a microstrip line filter which is contained within a metal casing.

SUMMARY OF THE INVENTION

It is an object of the present invention to provide a filter which reduces a radiation loss occurring in a filter contained within a casing.

In a filter contained within a casing and comprising at least one resonator formed by a signal conductor formed on at least one surface of a dielectric substrate and an input/output terminal section formed on the dielectric substrate and coupled with the resonator, in accordance with the present invention, the casing has an internal wall surface which is formed by a superconductor layer.

The signal conductor mentioned above refers to a center conductor of a coplanar line or a signal line of a microstrip line resonator.

With the arrangement according to the present invention, a very simple structure that the internal wall surface of the casing is formed by a superconductor layer can be used and the superconductor layer may be maintained in its superconducting state to prevent a loss from occurring if part of the electromagnetic power which is irradiated from the filter causes an induced current to flow through the internal wall surface of the casing inasmuch as the superconductor layer presents a resistance of zero to the flow of the induced current. Accordingly, the filter contained in the casing has a reduced loss in comparision to the prior art.

BRIEF DESCRIPTIONS OF THE DRAWINGS

Figure 5:
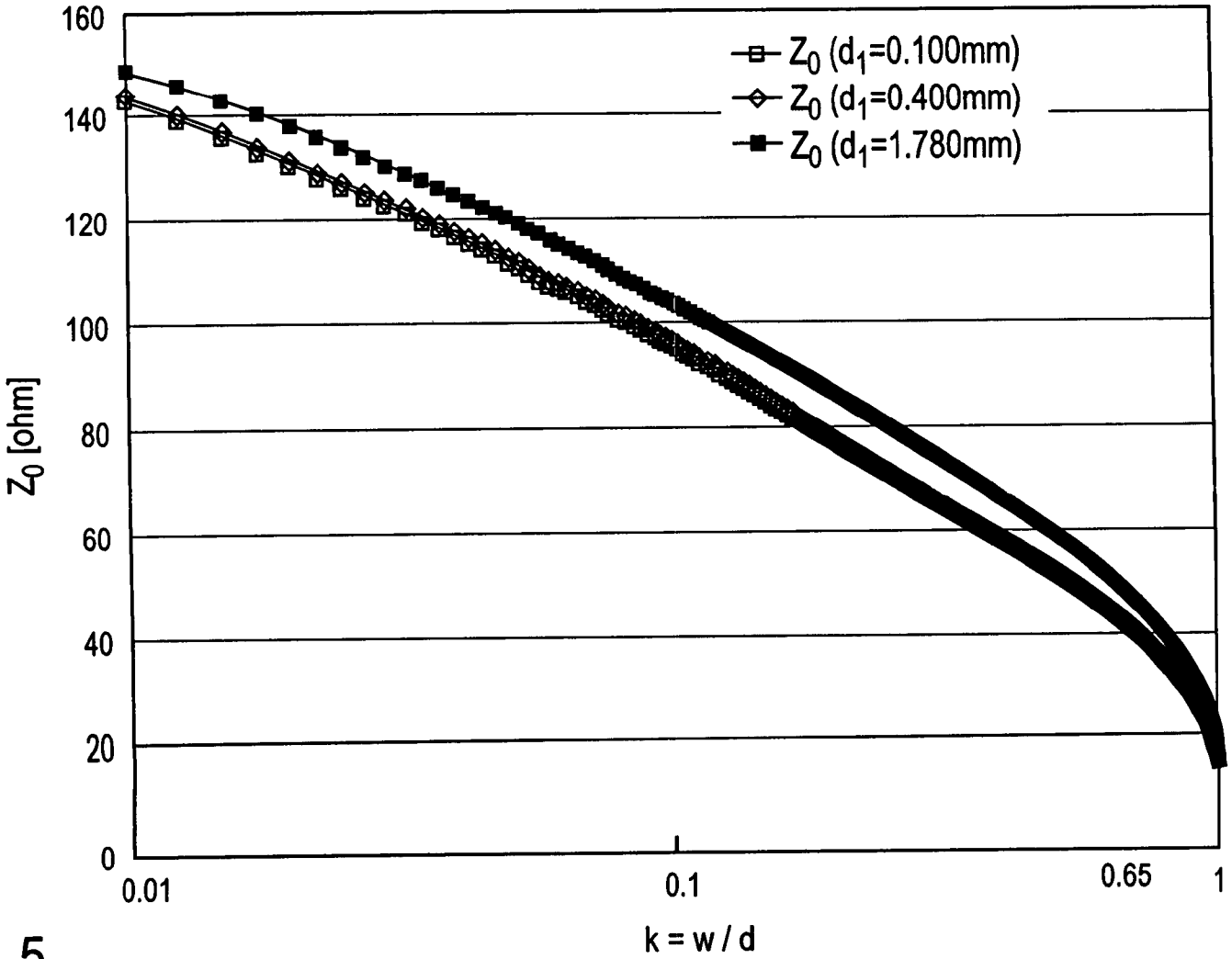
Figure 7:
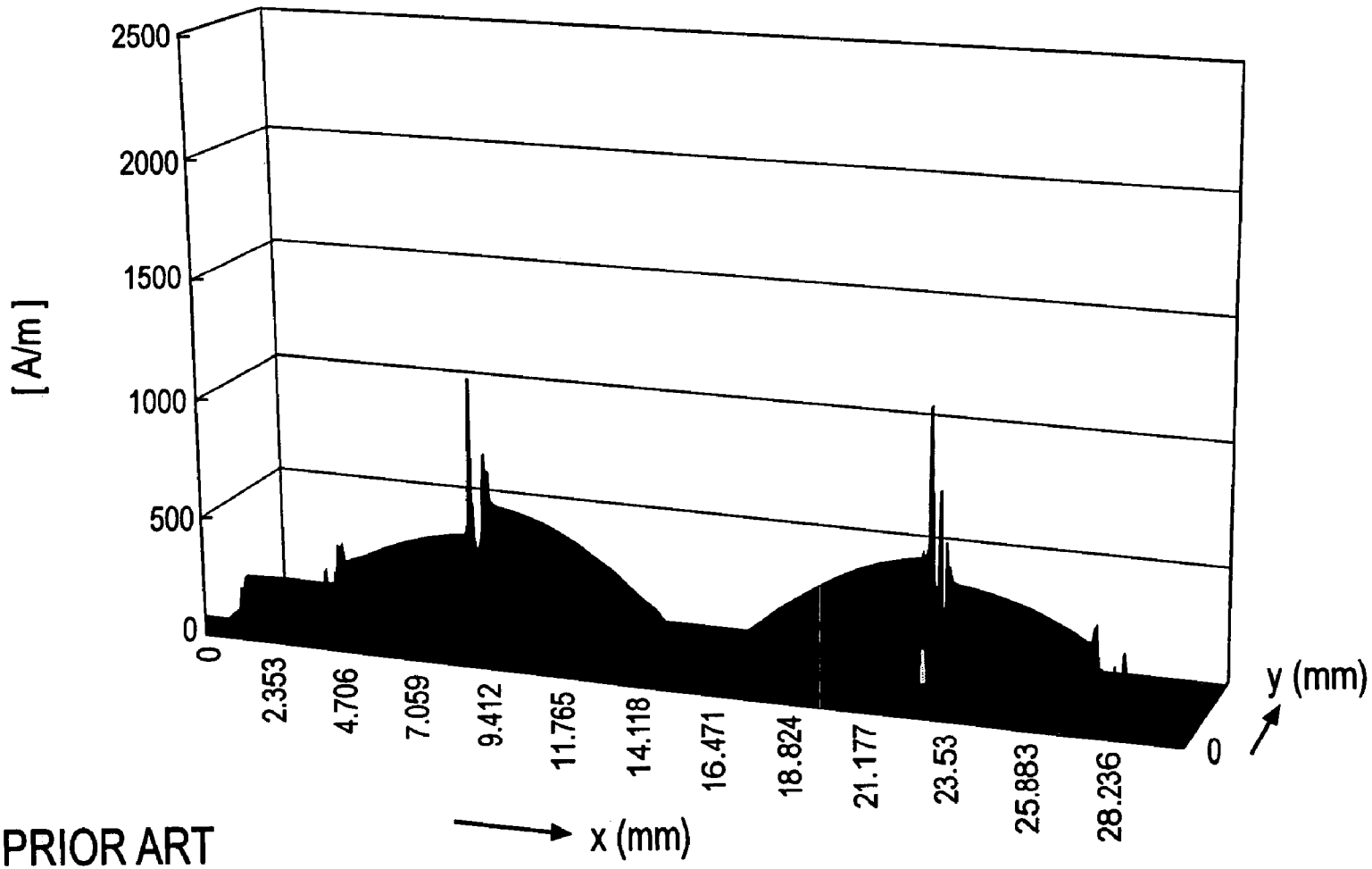
PRIOR ART FIG. 7
Figure 8:
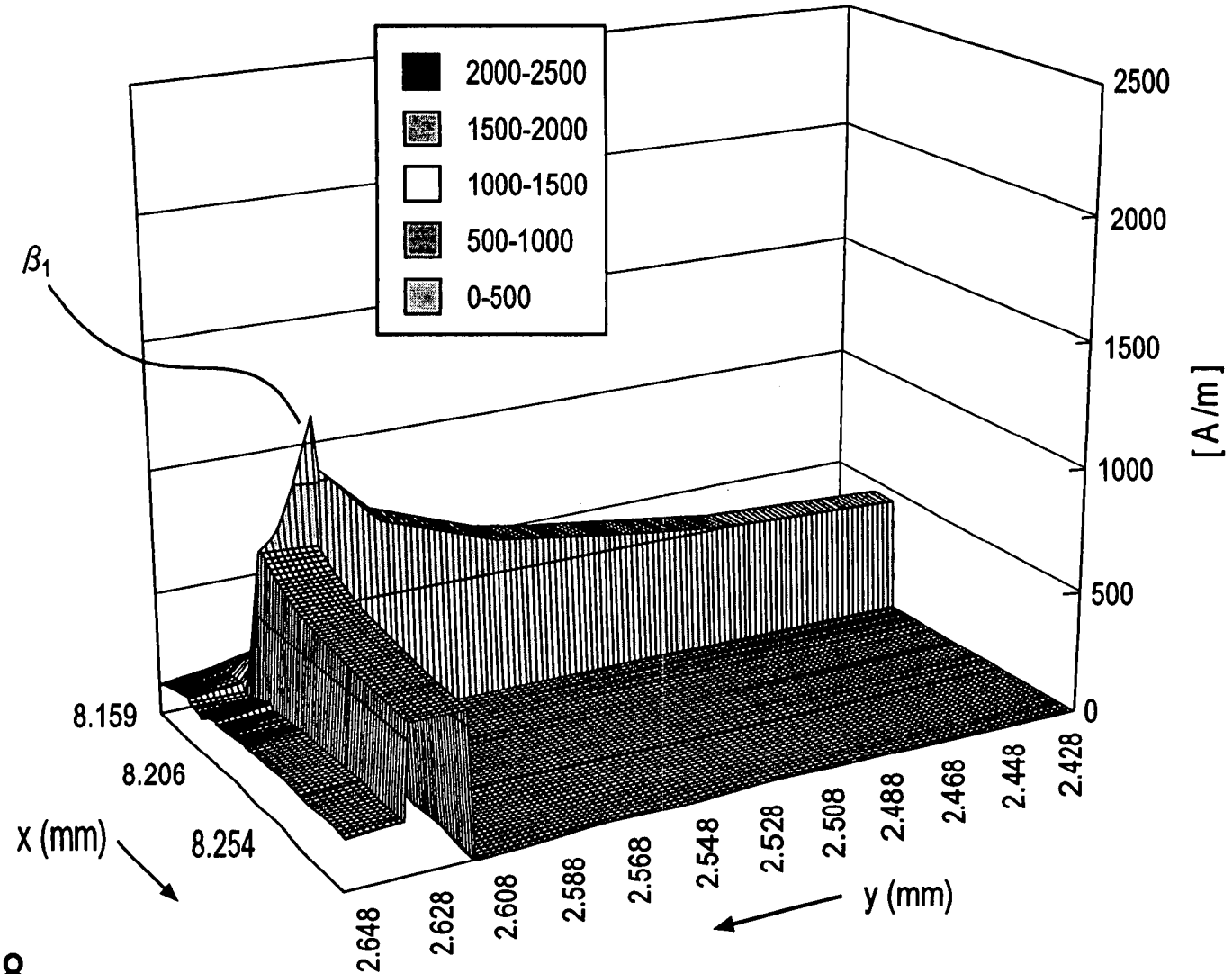
Figure 9:
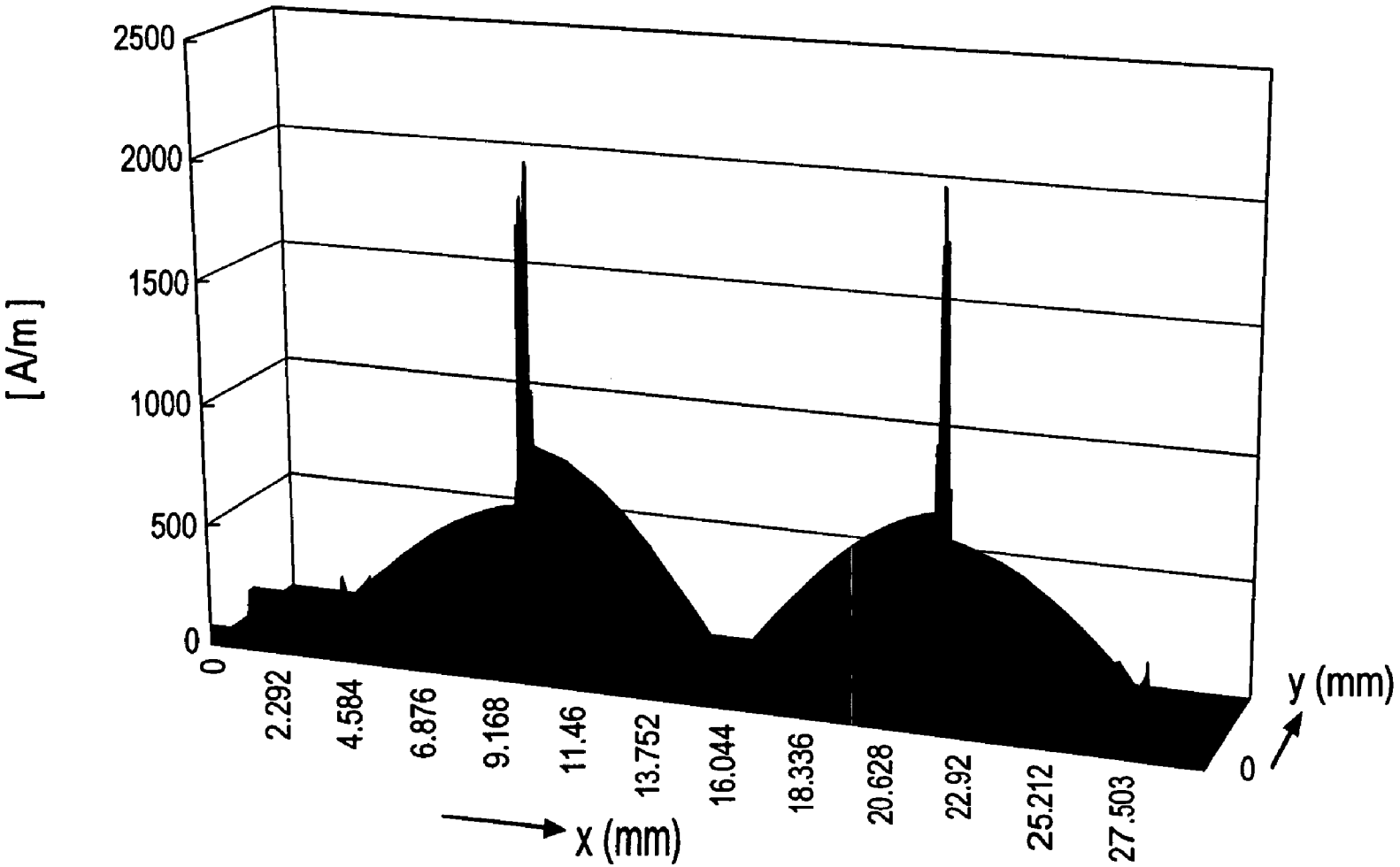
Figure 10:
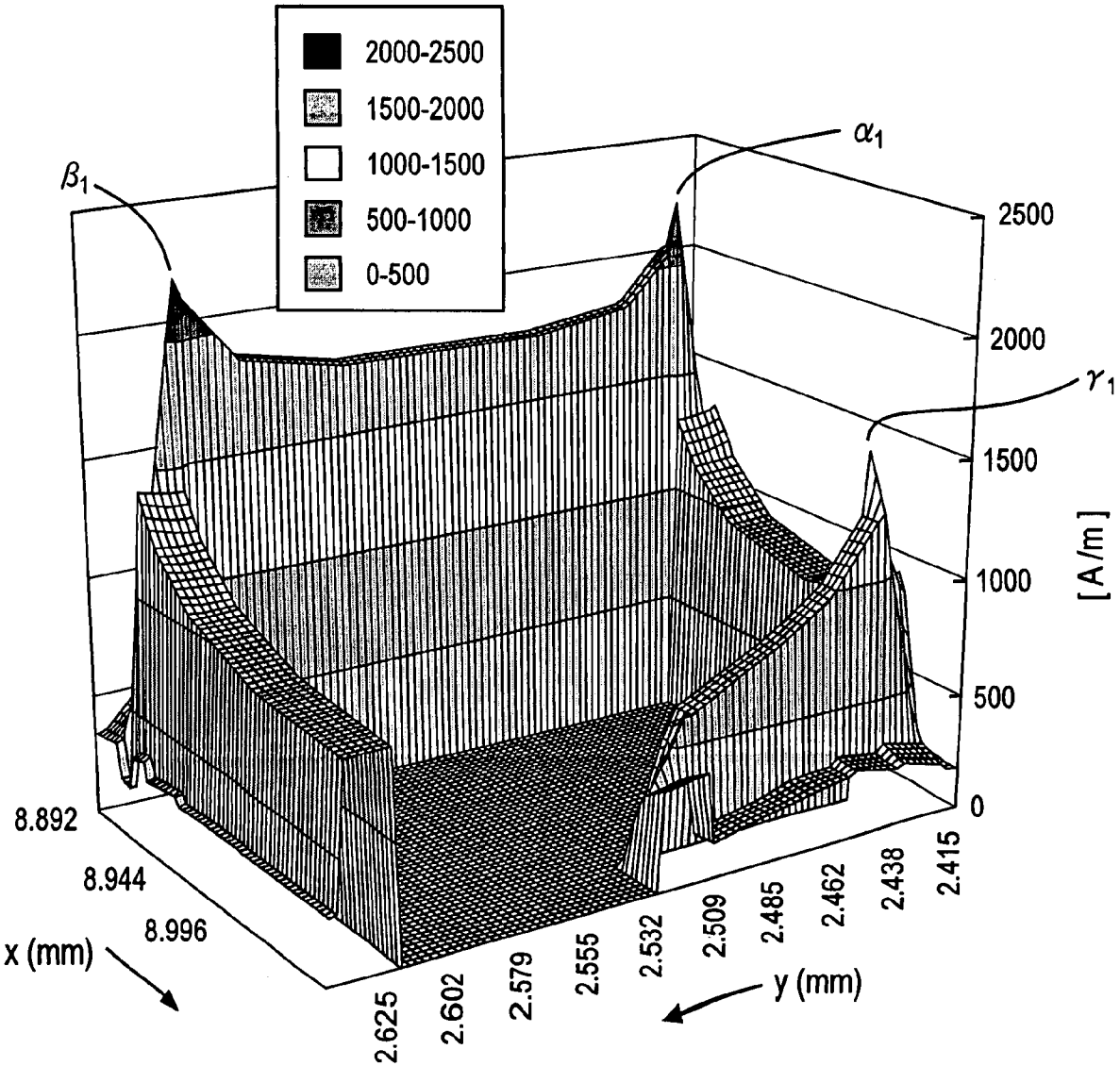
PRIOR ART FIG. 10
Figure 11:
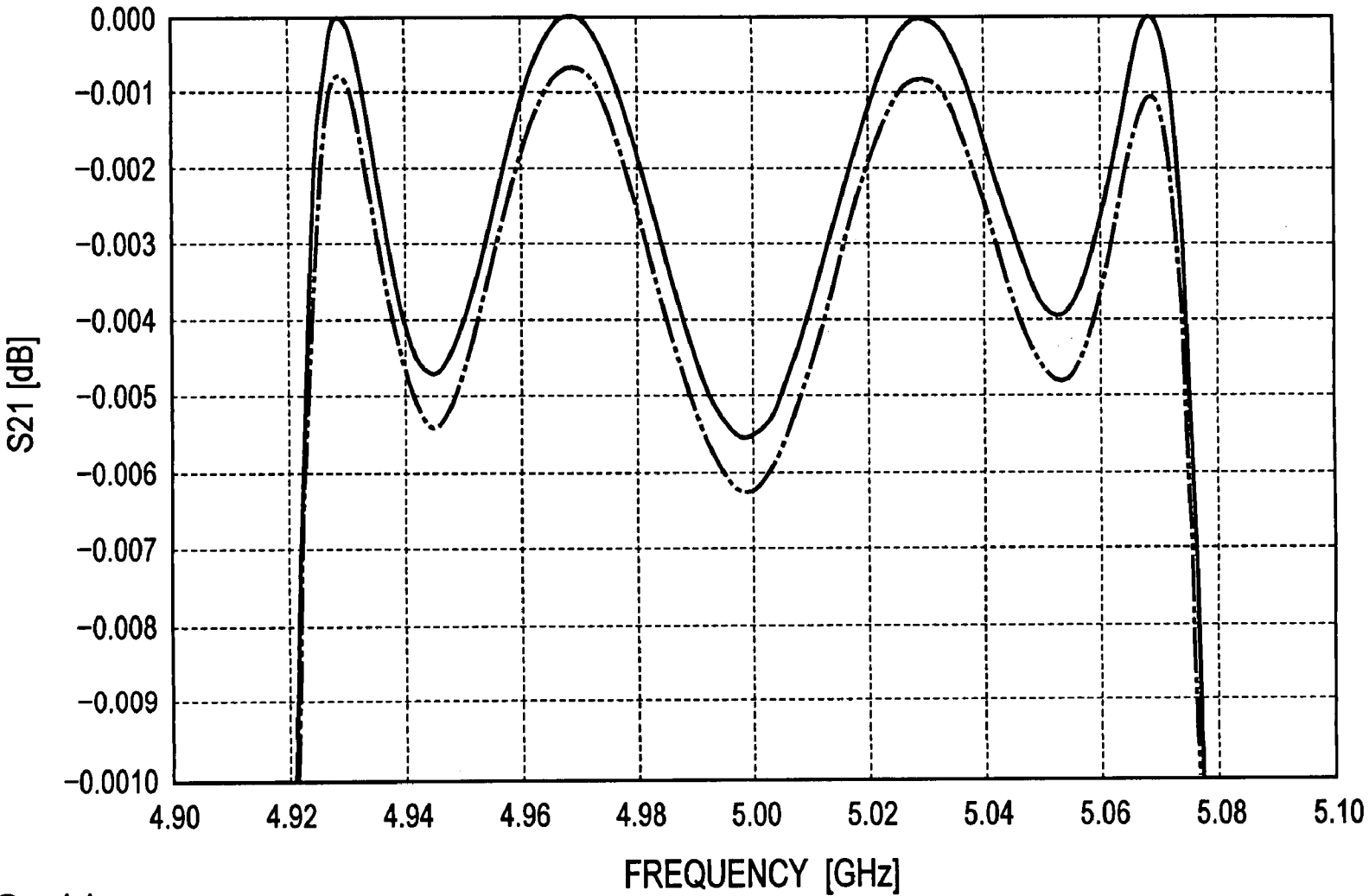
Figure 12:
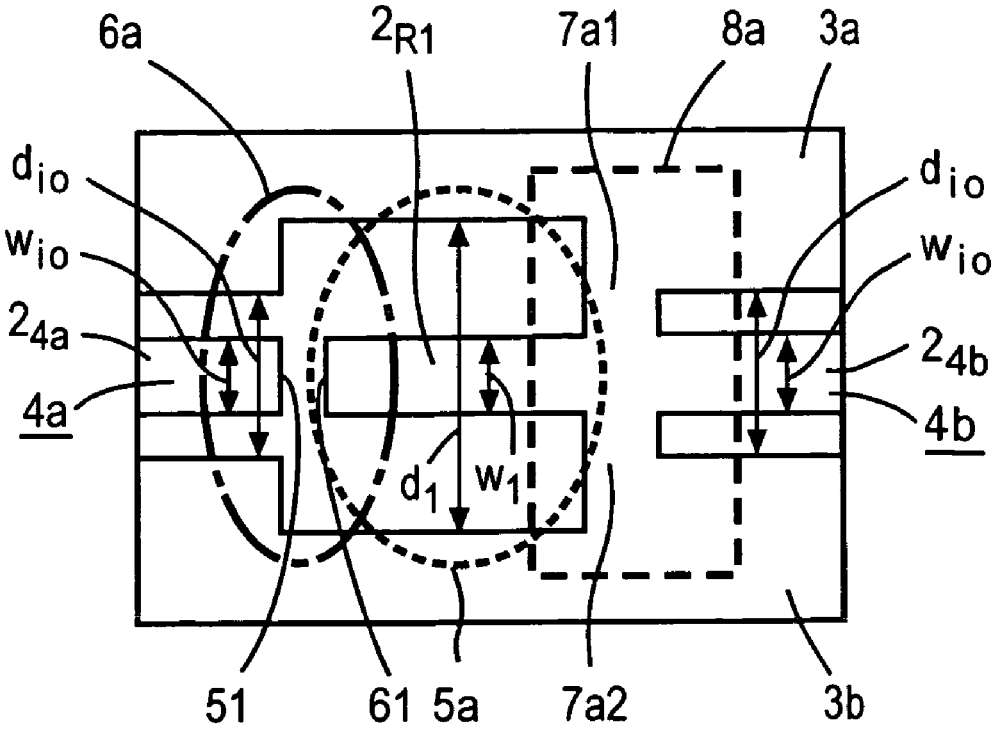
Figure 13:
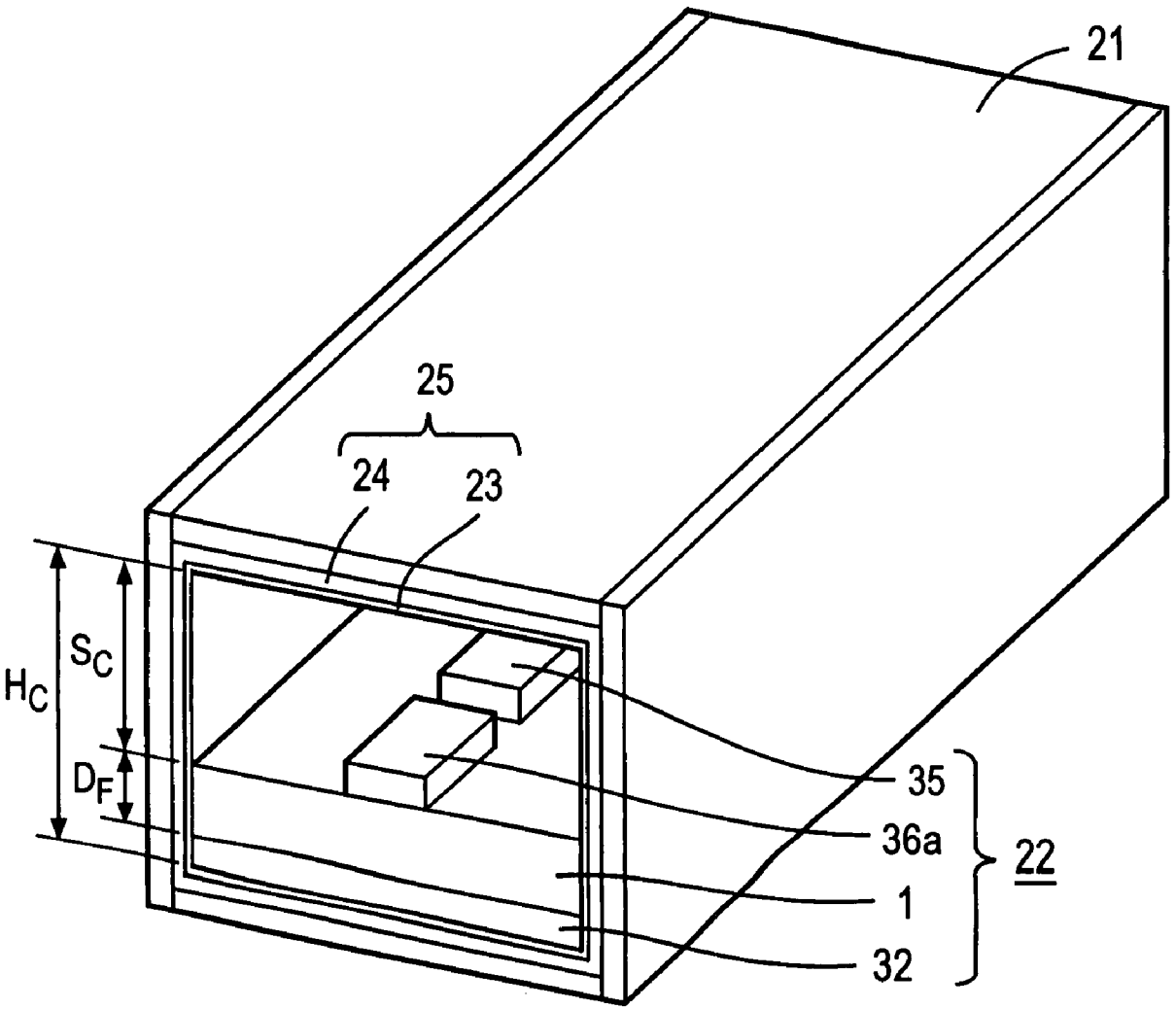
Figure 14B:
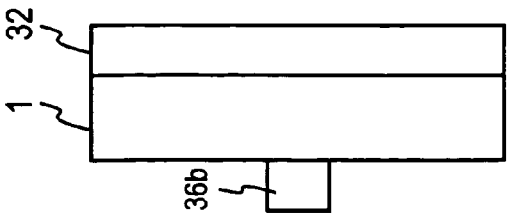
Figure 14A:
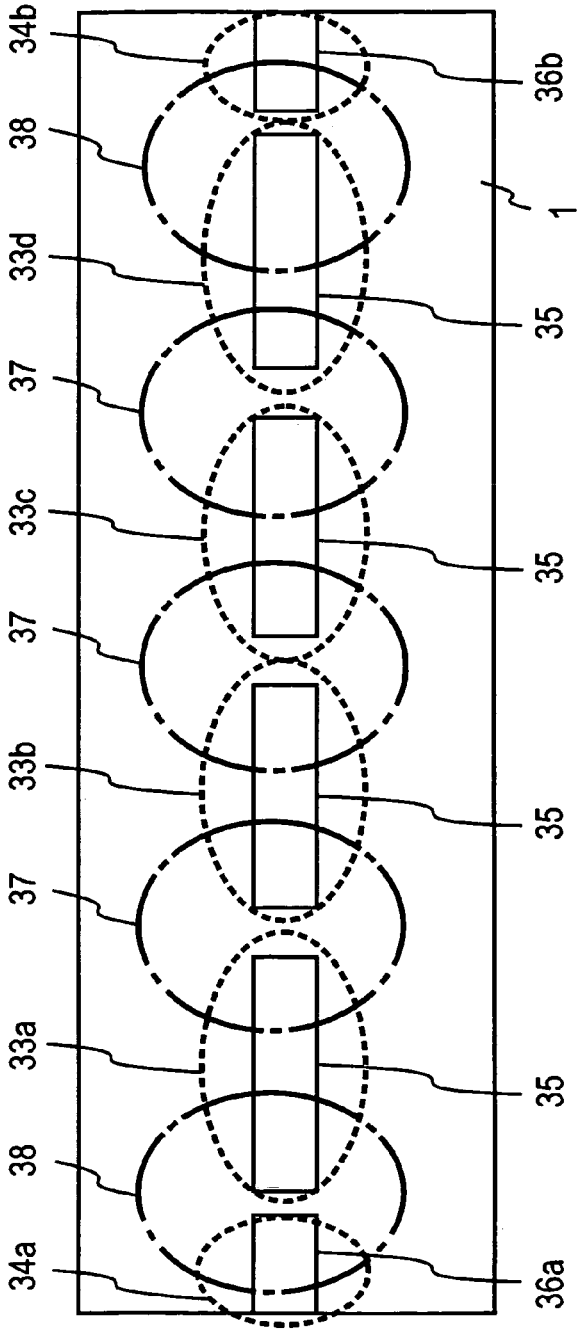
Figure 14C:
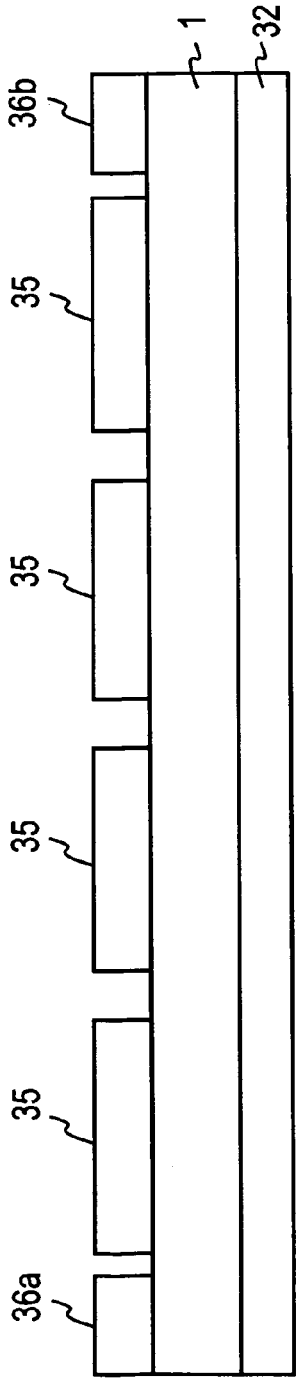

FIG. 5 graphically shows an exemplary characteristic impedance plotted against the ratio k of the center conductor line width with respect to the ground conductor spacing in a filter according to the first mode of carrying out the invention;

FIG. 6A is a plan view of one-quarter wavelength four stage coplanar waveguide filter according to the first mode of carrying out the invention;

FIG. 6B is a right-hand side elevation of FIG. 6A;

FIG. 6C is a front view of FIG. 6A;

FIG. 7 graphically shows a current density distribution of the one-quarter wavelength four stage coplanar waveguide filter shown in FIG. 6;

FIG. 8 graphically shows a current density distribution of an inductive coupler in the one-quarter wavelength four stage coplanar waveguide filter shown in FIG. 6;

FIG. 9 graphically shows a current density distribution of the one-quarter wavelength four stage coplanar waveguide filter shown in FIG. 2;

FIG. 10 graphically shows a current density distribution of an inductive coupler in the one-quarter wavelength four stage coplanar waveguide filter shown in FIG. 2;

FIG. 11 graphically shows a result of simulations for the transmission frequency response of the filter of the prior art and the filter according to the first embodiment;

FIG. 12 is a plan view of an embodiment in which the first embodiment is applied to a single stage resonator filter;

FIG. 13 is a perspective view illustrating the application of the present invention to a microstrip line resonator filter;

FIG. 14A is a plan view of the filter contained in the embodiment shown in FIG. 13;

FIG. 14B is a right-hand side elevation of FIG. 14A and;

FIG. 14C is a front view of FIG. 14A.

BEST MODES FOR CARRYING OUT THE INVENTION

Figure 3:
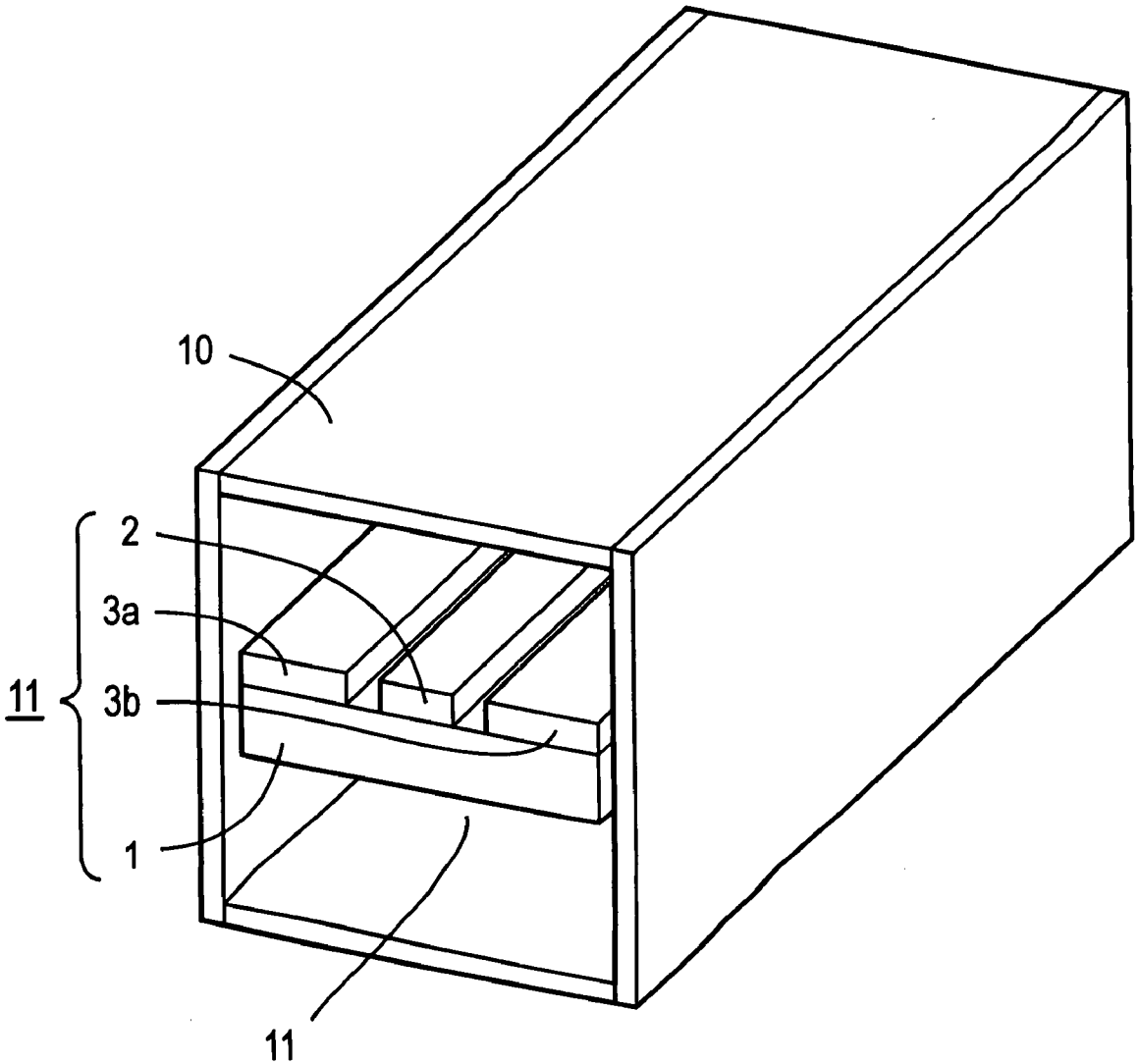
PRIOR ART FIG. 3
FIG. 3 is a perspective view of a conventional coplanar waveguide filter contained within a casing.
Figure 4:
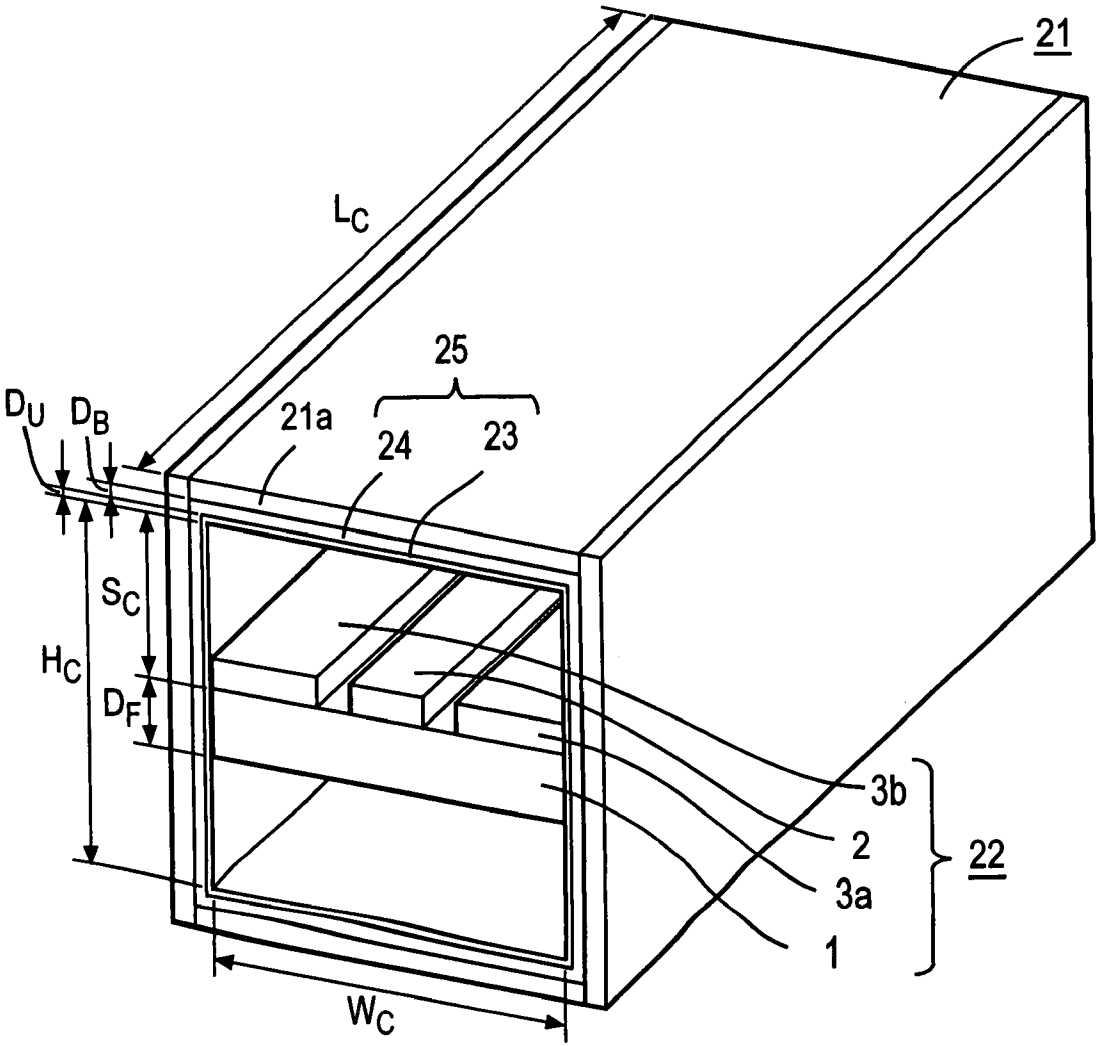
FIG. 4 is a perspective view of an embodiment of the present invention in which a superconductor layer is formed on the internal surface of the casing.

One embodiment of the present embodiment is shown in FIG. 4. Contained within a square tubular casing 21 is a coplanar waveguide filter 22, which comprises a center conductor 2 and ground conductors 3*a* and 3*b* disposed on the opposite sides of the center conductor, both formed on a dielectric substrate 1. The coplanar waveguide filter 22 has a length which is equal to the length $L_c$ of the casing 21 so that the filter 22 is a just fit therein. While not shown, the filter includes a resonator and a first and a second input/output terminal section. In the similar manner as one shown in FIG. 3, the filter 22 is disposed so as to oppose one sidewall of the casing 21, which is halved by the filter 22. To give an example, the casing 21 has a width $W_c$ of 5.4 mm, a height $H_c$ of 8 mm and a length $L_c$ of 30 mm and there is a spacing $S_c$ of 4.5 mm between the dielectric substrate 1 and the casing 21. In this embodiment, the internal wall surface of the casing 21 is formed by a superconductor layer 23. By way of example, a square tubular outer wall body 21*a* is formed of a metal material, for example, in order to maintain the configurational integrity of the casing 21, and the entire internal surface of the outer wall body 21*a* is formed by the superconductor layer 23. The superconductor layer 23 can be formed by depositing lanthanum-, yttrium-, bismuth-, thallium- or other high temperature superconductor on a substrate 24 of metal oxide material such as MgO, $SrTiO_3$, $LaGaO_3$ or $LaAlO_3$ by a film forming method such as sputtering, vacuum evaporation, CVD process or silk screening thick film formation or the like to define the superconducting layer 23, and a resulting substrate 25 with a film of superconductor is applied, as with an adhesive, to the internal surface of the outer wall body 21*a*. In the example shown, the substrate 25 with a film of superconductor is applied to plate materials which define the outer wall body 21*a* for the four side walls of the square tubular casing 21 to be assembled into the square tubular casing 21.

The superconductor layer 23 has a thickness which is chosen so that in the event the electromagnetic power which is irradiated from the filter 22 impinges on the internal surface of the casing 21 to produce a current flow, a sufficiently low resistance, which is substantially equal to zero resistance, is presented to the current flow. By way of example, the superconductor layer 23 has a thickness $D_u$ of 5000Å, and the substrate 24 has a thickness $D_B$ equal to 0.5 mm. To maintain the layer 23 of high temperature superconductor in its superconducting state, a material having a high thermal conductivity is preferred to construct the outer wall body 21*a*, and it is contemplated that a copper plate plated with gold be used at this end in consideration of the erosion resistance.

The electromagnetic power which is irradiated form the coplanar waveguide filter 22 to impinge on the internal wall surface of the casing produces an induced current in the inner wall, producing a power loss of $RI^2$ where I represents the current and R the surface resistance of the internal wall of the casing. However, in the example shown in FIG. 4, R is nearly equal to 0, and thus the power dissipation is greatly reduced by the casing 21.

The present invention is particularly effective when an increased amount of electromagnetic power is irradiated from the filter as when there is a mismatch between the characteristic impedance of the input/output terminal section and the characteristic impedance of the resonator, for example. Accordingly, the characteristic impedance of the coplanar waveguide filter will now be considered. A relationship between a current and a voltage on a distributed constant line is generally given by following equations:

$$\dot{I} = \frac{\dot{V}_i}{Z}e^{-\gamma z} - \frac{\dot{V}_r}{Z}e^{\gamma z} = \dot{I}_i e^{-\gamma z} + \dot{I}_r e^{\gamma z}$$

$$Z = \sqrt{\frac{R + j\omega L}{G + j\omega C}},\ \gamma = \alpha + \beta,\ \alpha = \frac{R}{2}\sqrt{\frac{C}{L}} + \frac{G}{2}\sqrt{\frac{L}{C}},\ \beta = \omega\sqrt{LC}$$

where $I_i$, $V_i$: a current value and a voltage value of a traveling wave $I_r$, $V_r$: a current value and a voltage value of a reflected wave γ: propagation constant α: attenuation constant β: phase constant Z: characteristic impedance R: series resistance L: series inductance G: parallel conductance C: capacitance.

A current value on a distributed constant line is inversely proportional to the characteristic impedance.

A characteristic impedance of a coplanar waveguide filter is given as follows:

$$Z_0 = \frac{\eta_0}{4\sqrt{\varepsilon_{eff}}} \times \frac{K'(k)}{K(k)}$$

where $\epsilon_{eff}$ represents an effective dielectric constant of a coplanar waveguide filter, $\eta_0$ a wave impedance in the free space, K(k) a perfect elliptic integral of first type, and' a derivative.

$\epsilon_{eff}$,$\eta_0$ and K(k) are represented as follows:

$$\varepsilon_{eff} = 1 + \frac{\varepsilon_r - 1}{2} \times \frac{K(k)}{K(k)} \times \frac{K(k_1)}{K(k_1)}$$

$$\eta_0 = \sqrt{\frac{\mu_0}{\varepsilon_0}} = 120\pi$$

$$K(k) = \int_0^1 \frac{dx}{\sqrt{(1 - x^2) \times (1 - k^2x^2)}}$$

$$k = \frac{w}{d}$$

$$k_1 = \frac{\sinh(\pi w/4h)}{\sinh(\pi d/4h)}$$

A characteristic impedance $Z_0$ is determined by the ratio k of the center conductor width w with respect to the ground conductor spacing d, the dielectric constant $\epsilon_r$ of the dielectric substrate and the thickness h of the dielectric substrate. Thus, as shown in FIG. 5, the characteristic impedance $Z_0$ can be increased by using the ratio k of the center conductor line width w with respect to the ground conductor spacing d as a parameter. In FIG. 5, the abscissa represents k=w/d and the ordinate represents the characteristic impedance $Z_0$ with the ground conductor spacing d representing a parameter.

Figure 1:
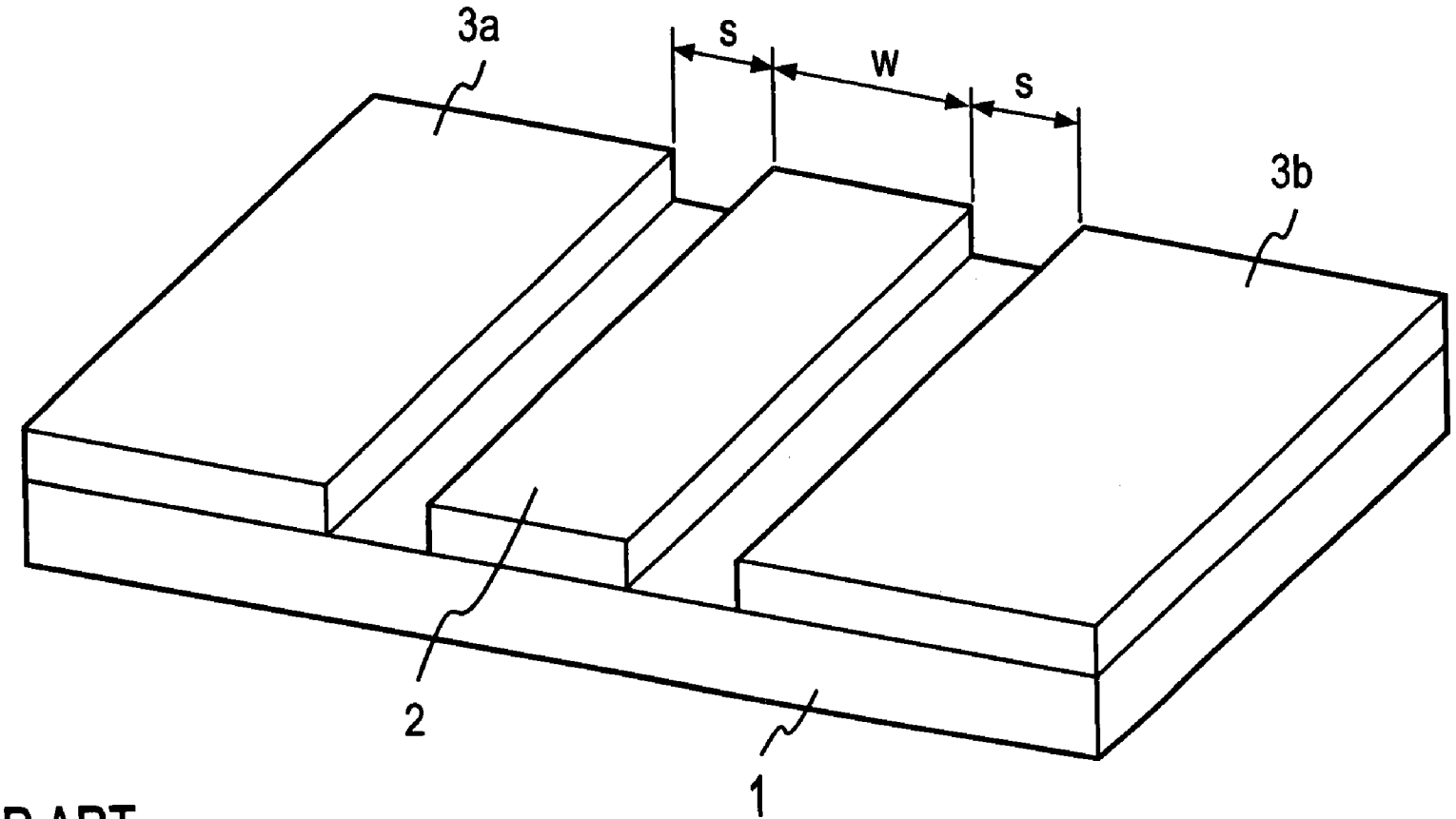
PRIOR ART FIG. 1
FIG. 1 is a perspective view illustrating the concept of a coplanar line.
Figure 2B:
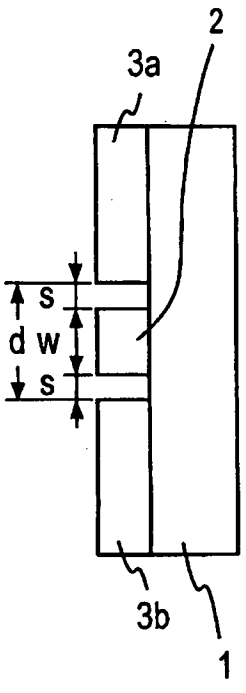
PRIOR ART FIG. 2B
FIG. 2B is a right-hand side elevation of FIG. 2A.
Figure 2A:
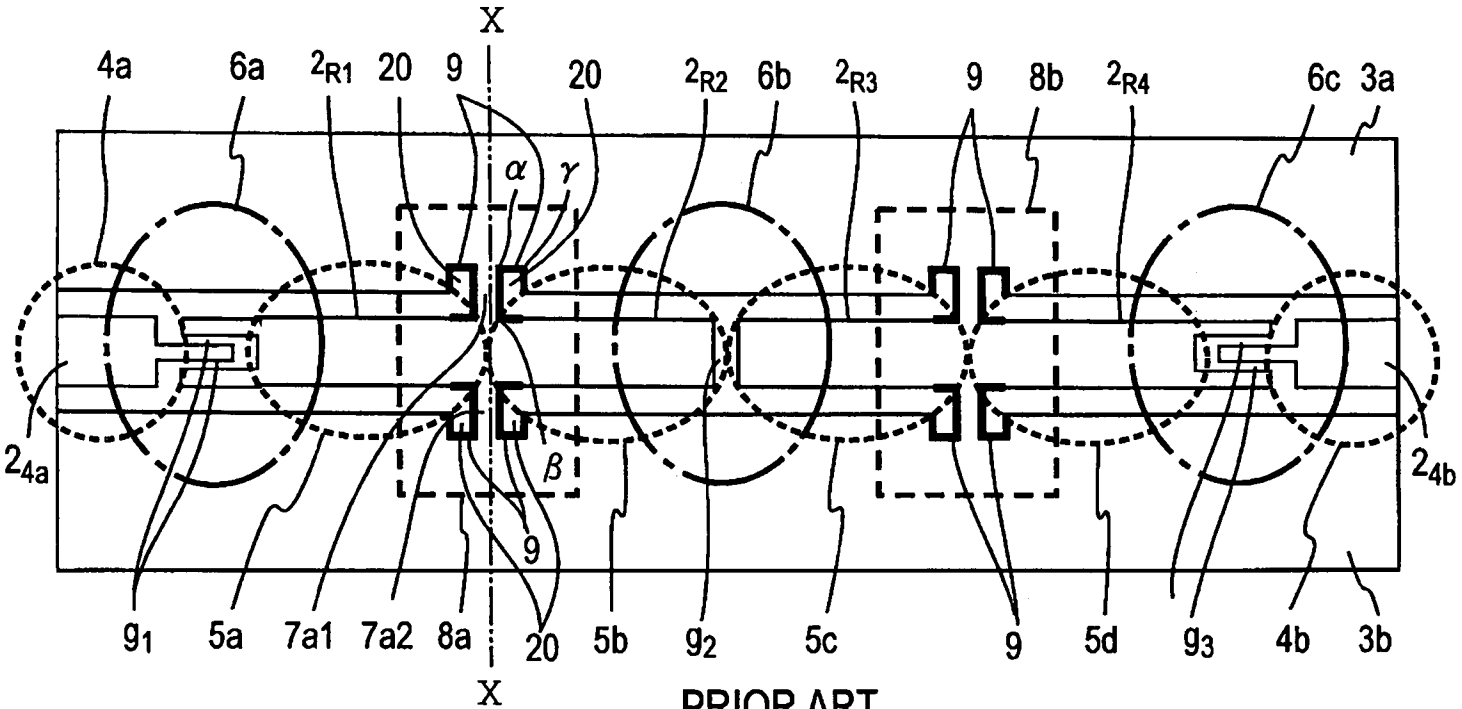
PRIOR ART FIG. 2A
FIG. 2A is a plan view of a conventional coplanar waveguide filter.
Figure 2C:
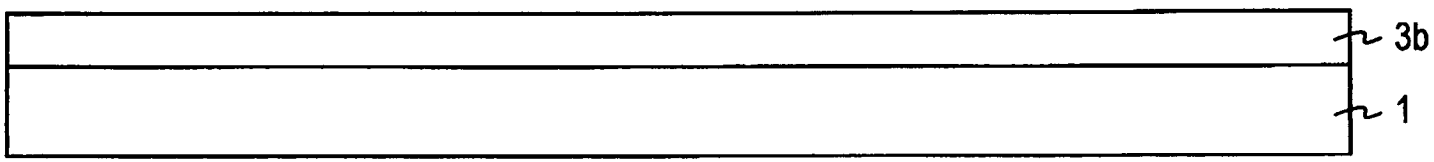
FIG. 2C PRIOR ART
FIG. 2C is a front view of FIG. 2A.

A specific example in which the resonator has a greater characteristic impedance than the input/output terminal section of the coplanar waveguide filter will be described. An example of such coplanar waveguide filter will be described with reference to FIG. 6A to 6C. It is to be noted that parts corresponding to those shown in FIGS. 2A to 2C are designated by like reference numerals as used before without duplicate description. In this example, the first and the second input/output terminal section 4*a* and 4*b* have a characteristic impedance of 50Ω while the first to the fourth resonator 5*a* to 5*b* have a characteristic impedance of 100Ω. Specifically, MgO substrate having a dielectric constant of 9.68 is used as the dielectric substrate 1, and the first and the second input/output terminal section 4*a* and 4*b* have a center conductor width $w_{io}$ of 218 μm and a ground conductor spacing $d_{io}$ of 400 μm. The first to the fourth resonator 5*a* to 5*b* have a center conductor width $w_1$, of 218 μm and a ground conductor spacing $d_1$ of 1,780μm.

Capacitive coupling ends 51 and 61 which define a first capacitve coupler 6*a* between the first input/output terminal section 4*a* and the first resonator 5*a* are extended toward the ground conductors 3*a* and 3*b* in a manner conforming to the increased ground conductor spacing $d_1$, and the capacitive coupling ends 51 and 61 oppose each other with a gap $g_1$ therebetween. The length over which the ends oppose to each other is chosen to be equal to the length over which the coupling ends of the first capacitive coupler 6*a* shown in FIG. 2 oppose to each other. Thus, the first capacitive coupler 6*a* is formed as a simple construction that the opposing edges of the coupling ends are formed to be linear without using a complicated construction of mating comb teeth.

Shorting line conductors 7*a*1 and 7*a*2 which couple between the first resonator 5*a* and second resonator 5*b* has a sufficient length to provide a satisfactory degree of coupling for an inductive coupler 8*a* due to an increased ground conductor spacing $d_1$ as compared with the prior art, without forming cuts 20 shown in FIG. 2A into the first and the second ground conductor 3*a* and 3*b* in regions of junctions between the shorting line conductors 7*a*1 and 7*a*2 and the first and the second ground conductor 3*a* and 3*b*. As a conseqence, the first inductive coupler 8*a* is also simpler in construction than that shown in FIG. 2.

A second inductive coupler 8*b* is constructed in the same manner as the first inductive coupler 8*a*. In this arrangement, a spacing S2 between each of the center conductors $\mathbf{2}_{R1}$ to $\mathbf{2}_{R4}$ and the ground conductors 3*a* and 3*b* is chosen to be equal to the length L of each of the shorting line conductors 7*a*1, 7*a*2 and 7*b*1, 7*b*2 which define the inductive couplers 8*a* and 8*b*, and no rectangular cuts 20 are formed into the ground conductors 3*a* and 3*b*.

In other words, the shorting line conductors 7*a*1 and 7*b*1 are connected at right angles to the ground conductor 3*a* and the edge of the junction located toward the ground conductor extends parallel to the center conductor $\mathbf{2}_{R1}$ and $\mathbf{2}_{R4}$ to the positions of the first capacitive coupler 6*a* and 6*b*.

As a consequence, a junction between the shorting line conductors 7*a* and 7*b* and the ground conductors assumes a simple configuration which facilitates the manufacture while reducing corners on the current carrying line where a current density is likely to be concentrated. An arrangement which follows the first resonator 5*a* is identical with the arrangement of the one-quarter wavelength four stage coplanar filter described above with reference to FIG. 2, except for the configuration of the coupling ends for the capacitive couplers and that no cuts are formed in the region of junction between the ground conductors and the shorting line conductors which define the inductive coupler. Accordingly, only a connection will be described.

Since the shorting conductors 7*a* and 7*b* are constructed in this manner, a spacing between each of the center conductors $2_{R2}$, $2_{R3}$, $2_{R4}$ of the resonators 5*b*, 5*c*, 5*d* and each of the ground conductors 3*a* and 3*b* is equal to S2. A second capacitive coupler 6*a* disposed between the second resonator 5*b* and the third resonator 5*c* is constructed in the similar manner as the second capacitive coupler 6*a* shown in FIG. 2. A third capacitive coupler 6*c* disposed between the fourth resonator 5*d* and the second input/output terminal section 4*b* is constructed in the similar manner as the first capacitive coupler 6*a* shown in FIG. 6. Specifically, a capacitive coupling end 6*b* at one end of the center conductor $2_{R4}$ and a capacitive coupling end 52 located at one end of the center conductor $2_{4b}$ are both wider linear members which are extended crosswise on the opposite sides with respect to each center conductor and these ends are closely opposing to each other to increase the degree of coupling.

In the filter shown in FIG. 6, the first input/output terminal section 4*a* has a characteristic impedance of 50Ω and the resonator has a characteristic impedance of 100Ω. Assuming that the first input/output terminal section 4*a* has a ground conductor spacing $d_{io}$ of 0.4 mm and a center conductor width $w_{io}$ of 0.218 mm and the resonator has a ground conductor spacing $d_1$ of 1.780 mm and a center conductor width $w_1$ of 0.218 mm, a simulation for the current density distribution in the one-quarter wavelength four stage coplanar waveguide filter of this numerical example has been made and its result is shown in FIG. 7.

X-axis represents a position in a direction along the length of the coplanar waveguide filter, y-axis represents a crosswise position, and the ordinate represents a current density. The current density distribution has nodes at the capacitive couplers 6*a* to 6*c* and anti-nodes at the inductive couplers 8*a* and 8*b*, thus assuming a substantially lunate waveform. A current density distribution on a line VIII—VIII indicated on the shorting line conductors 7*a*1 and 7*a*2 in FIG. 6 is shown to an enlarged scale in FIG. 8. The current density is at its maximum at the first inductive coupler 8*a* which is located at a distance of about 8.0 mm from the input end of the coplanar line and also at the second inductive coupler 8*b* which is located at a distance of about 22 mm from the input end. The peak of the current density is about 1200A/m. FIG. 8 graphically shows a current density distribution of the first inductive coupler 8*a* to an enlarged scale. A position located at a distance of 8.159 mm from the signal input end of the first input/output terminal section 4*a* lies on the shorting line conductor 7*a*1 and corresponds to a portion indicated by the line VIII—VIII shown in FIG. 6. Thus, an X-axis position which is stepped back by about 0.02 mm toward the input from the lateral edge of the shorting line conductor 7*a*1 which is disposed toward the resonator 5*b* represents the 8.159 mm position shown in FIG. 8. FIG. 8 shows a current density distribution in a range extending about 0.1 mm toward the output from this position. A current concentration occurs at a corner β where the shorting line conductor 7*a*1 contacts the center conductor $2_{R2}$, but there is no current concentration at any other corner.

For the sake of reference, a result of simulation for the current density distribution performed on the coplanar waveguide filter shown in FIG. 2 when the first and the second input/output terminal section 4*a* and 4*b* each have a width $w_{io}$ of 0.218 mm for the center conductors $2_{4a}$ and $2_{4b}$ and a ground conductor spacing $d_1$ of 0.4 mm and the resonators 5*a* to 5*d* each have a width $w_1$ of 0.218 mm for the respective center conductor $2_{R1}$ to $2_{R4}$ and a ground conductor spacing $d_1$ of 0.4 mm, and thus have the same values as the input/output terminal sections 4*a* and 4*b* is shown in FIGS. 9 and 10, which correspond to FIGS. 7 and 8, respectively. In the similar manner as in FIG. 7, the current density is at its maximum at the edge line 9 (shown in thick line in FIG. 2) of the first and the second inductive coupler 8*a* and 8*b*, and exhibits a maximum value of about 2200 A/m at the first inductive coupler 8*a* which is located at a distance of about 8.5 mm from the input end of the coplanar waveguide filter and also at the second inductive coupler 8*b* which is located at a distance of about 20 mm from the input. A position shown at 8.892 mm on the X-axis in FIG. 10 corresponds to a portion indicated by the line X—X in FIG. 2. Specifically, an X-axis position which is stepped back by 0.014 mm toward the input from the lateral edge of the shorting line conductor 7*a*1 which is disposed toward the second resonator 5*b* represents a position of 8.8917 mm in FIG. 10. FIG. 10 shows a current density distribution in a range of 0.1 mm extending from this position toward the output. It will be seen that the current density is particularly high at two locations including the corner α where the shorting line conductor 7*a*1 contacts the first ground conductor 3*a* and the corner β where the shorting line conductor 7*a*1 contacts the center conductor $2_{R2}$, and that the current concentration occurs at the corner γ which is located opposite from the corner α of the rectangular cut 20 into the first ground conductor 3*a* which is provided for the purpose of increasing the degree of coupling of the inductive coupler 8. Such a current concentration has peaks also at corners which are disposed in line symmetry to the corners α, β and γ with respect to a centerline of the width of the shorting line conductor 7*a*l. In this manner, a particularly high current concentration peak occurs at three locations including the corners α, β and γ. It is obvious that the same tendency prevails at corners which are formed between the shorting line conductor 7*a*2 and the center conductor $2_{R2}$ and the second ground conductor 3*b*.

It is seen from the above that the filter shown in FIG. 6 has a single peak of the current density with a peak value of about 1200 A/m which is reduced as compared with the filter shown in FIG. 2 and is suppressed to a magnitude of about 55% of the prior art. The current density in each of the resonators 5*a* to 5*b* is reduced, achieving a reduction in the maximum current density of about 45% which is converted into a power reduction of about 70%.

It should be noted that using the characteristic impedance of the resonator which is equal to 100Ω produces a mismatch of the characteristic impedance at the first and the second input/output terminal section 4*a* and 4*b*. In this respect, for the first input/output terminal section 4*a*, the first capacitive coupler 6*a* which is connected between the first input/output terminal section 4*a* and the first resonator 5*a* acts as an impedance converter, preventing a reflection loss from occurring. Similarly, for the second input/output terminal section 4*b*, the third capacitive coupler 6*c* acts as an impedance converter.

FIG. 11 graphically shows a result of a simulation performed for an in-band insertion loss of the coplanar waveguide filter shown in FIG. 6 when it is contained within the metal casing 10 shown in FIG. 3 and when it is contained within the casing 21 of the embodiment shown in FIG. 4. The filter which is contained in the casing has sizes mentioned previously, the dielectric substrate 1 has a thickness $D_F$ of 0.5 mm, the casings 10 and 21 have an equal size having numerical figures mentioned previously, and spacing $S_c$ between the surface of the dielectric substrate 1 on which the center conductor and the ground conductors are formed and the casing 10 or 21 as the filter is contained within the casing is equal to 4.5 mm. The metal casing 10 comprises a casing formed by copper plates evaporated with gold thereon, and the superconductor layer 23 of the casing 21 assumes a superconducting state and thus is assumed to present a resistance of 0 for purpose of simulation.

In FIG. 11, the abscissa represents the frequency, and the ordinate the transmittance S21, and chain lines indicated the transmittance when contained within the metal case 10 while the solid line indicates the transmittance when contained within the casing 21. It will be noted from FIG. 11 that the in-band insertion loss is about 0.0063 dB when the metal casing 10 is used and is equal to about 0.0055 dB when the casing 21 having the superconductor layer 23 formed on the internal surface thereof is used, thus allowing a reduction over the former of about 0.001 dB.

While the filter insertion loss can be reduced by forming the center conductor and the ground conductors of the coplanar waveguide filter with a superconductor or a high temperature superconductor, it will be noted that when the arrangement of the coplanar waveguide filter shown in FIG. 6 is used, a current flow through the filter is reduced due to an increased characteristic impedance and the number of locations where peaks occur in the current density distribution is reduced with a reduced peak value, thus allowing a filter insertion loss to be substantially reduced.

In the foregoing, an example in which the four resonators 5*a* to 5*b* have been connected in series has been described, but it should be understood that the number of resonators are not limited to four. Even a single stage of resonator can function as a filter. An example of a filter which is formed by a single stage resonator is shown in FIG. 12. One end of a center conductor $\mathbf{2}_{R1}$ of a first resonator 5*a* is coupled to a first input/output terminal section 4*a* by a first capacitive coupler 6*a*, and the other end of the center conductor $\mathbf{2}_{R1}$ is coupled to a second input/output terminal section 4*b* through a first inductive coupler 8*a*. The center conductor width $w_{io}$ of the first and the second input/output terminal section 4*a* and 4*b* is chosen to be equal to the center conductor line width $w_1$ of the resonator while the ground conductor spacing $d_1$ of the resonator 5*a* is chosen to be greater than the ground conductor spacing $d_{io}$ of the first and the second input/output terminal section 4*a* and 4*b*. A capacitive coupling end 51 of the first capacitive coupler 6*a* which is disposed toward the input/output terminal section 4*a* represents a simple extension of the center conductor $\mathbf{2}_{4a}$, and a capacitive coupling end 61 disposed toward the center conductor $\mathbf{2}_{R1}$ and which opposes the coupling end 51 is directly defined by the center conductor $\mathbf{2}_{R1}$ itself. Accordingly, the first capacitive coupler 6*a* has a strength of coupling which is less than that of the first capacitive coupler 6*a* shown in FIG. 6.

The center conductor $\mathbf{2}_{4b}$ of the second input/output terminal section 4*b* is directly connected with shorting line conductors 7*a*1 and 7*a*2, thus coupling the resonator 5*a* and the second input/output terminal section 4*b* through an inductive coupler 8*a*. The coupling between the resonator and the input/output terminal section is set up in accordance with a balance of a design for the strength of coupling, and may comprise either a capacitive or an inductive coupling.

In order to allow different characteristic impedances to be used for an input/output terminal section and a resonator in a coplanar waveguide filter, the center conductor width $w_1$, of the resonator may be chosen to be greater than the center conductor width $w_{io}$ of the input/output terminal section while the ground conductor spacing $d_{io}$ of the input/output terminal section and the ground conductor spacing $d_1$ of the resonator are chosen to be equal to each other, thereby providing a reduced characteristic impedance for the resonator than for the input/output terminal section.

It should be understood that the resonator used in accordance with the invention is not limited to a coplanar resonator, but may comprise a microstrip line resonator, for example. FIG. 13 shows an embodiment therefor. A square tubular casing 21 has a superconductor layer 23 formed on its internal surface in the similar manner as shown in FIG. 4. A microstrip line filter 31 is contained within the casing 21. An example of the microstrip line filter 31 is shown in FIGS. 14A to 14C. A ground conductor 32 is formed on one surface of a dielectric substrate 1, which is the entire bottom surface thereof in the example shown. A plurality of microstrip line resonators 33*a* to 33*d* which cooperate with the ground conductor 32 are formed on the other surface, which is the top surface, of the dielectric substrate 1 on a line and are sequentially coupled together electromagnetically as an array. Line input/output terminal sections 34*a* and 34*b* which functions as microstip lines together with the ground conductor 32 are formed at the opposite ends of the array of the resonators 33*a* to 33*d*.

In this example, each of the resonators 33*a* to 33*d* comprises a filter signal line 35 having an electrical length equal to one-half wavelength which is formed on the dielectric substrate 1, and the signal lines 35 of the respective resonators 33*a* to 33*d* are disposed in a linear array in the direction of the array of the resonators. Input/output signal lines 36*a* and 36*b* which functions as microstrip lines by cooperation with the ground conductor 32 are formed on the dielectric substrate 1 in alignment with the array of the signal lines 35 at the opposite ends thereof. Opposing edges of filter signal lines 35 of adjacent resonators are disposed in opposing relationship with each other with a spacing which assures a required degree of coupling, thus forming a capacitive coupler 37. Finally, the filter signal lines 35 of the resonators 33*a* and 33*d* and the input/output signal lines 36*a* and 36*b* of the input/output terminal sections 34*a* and 34*b* have their opposing edges disposed closely spaced from each other, thus forming capacitive couplers 38.

In this microstrip line filter 31, there is no irradiation of electromagnetic power from the ground conductor 32, and accordingly, the ground conductor 32 is contained within the casing 21 while it is in contact with one sidewall thereof. As a consequence, the height $H_c$ of the casing 21 can be reduced. In addition, the internal wall surface of the casing 21 which is in contact with the ground conductor 32 may be left without a superconductor layer 23, and the ground conductor 32 may be directly applied to the internal surface of the casing 21 itself.

While a filter which is contained within the casing 21 has been principally described in terms of a coplanar waveguide, a cavity resonator type structure, a microstrip line structure, a coplanar line structure of flat circuit type using slotline or coplanar strips as well as a variety of many other structures may be adopted according to the present invention. In the described embodiments, a center conductor of the coplanar waveguide filter and a signal line of a microstrip line are collectively referred to as a signal conductor. A coplanar waveguide filter with a ground conductor may be contained within the casing 21. In this instance, the ground conductor may be brought into contact with the internal wall surface of the casing 21 when it is contained therein.

What is claimed is:

1. A casing contained filter comprising:

a filter formed on a dielectric substrate; and a casing in which the filter is contained, the filter comprising at least one resonator formed on the dielectric substrate and a first and a second input/output terminal section formed on the dielectric substrate and coupled with the resonator, the resonator comprising a signal conductor formed on one surface of the dielectric substrate and a ground conductor formed on at least one of said one surface and the opposite surface of the dielectric substrate, the casing comprising a square tubular body of copper plate which is plated with gold, and a high temperature superconductor such as lanthanum-, yttrium-, bismuth- or thallium-superconductor is deposited as a film on a substrate of a metal oxide material such as MgO, $SrTiO_3$, $LaGaO_3$, $LaAlO_3$ to provide a superconductor filmed substrate which is applied to the internal wall of the square tubular body.

2. A casing contained filter according to claim 1 in which the first and the second input/output terminal section have a characteristic impedance which is different from the characteristic impedance of the resonator.

3. A casing contained filter according to claim 1 in which the filter comprises a coplanar waveguide filter and the resonator comprises the signal conductor, and a first and a second ground conductor formed on the same surface of the dielectric substrate and on the opposite sides of and in parallel relationship with the signal conductor, the opposite surfaces of the dielectric substrate being spaced from opposing internal surfaces of the casing.

4. A casing contained filter according to claim 1 in which the filter comprises a microstrip line filter and the resonator comprises a signal conductor formed on one surface of the dielectric substrate and a ground conductor formed on the other surface of the dielectric surface over the entire area, the surface of the dielectric substrate on which at least the signal conductor is formed being spaced from the opposing internal surface of the casing.

5. A casing contained filter according to claim 4 in which the surface of the casing which opposes the ground conductor is not formed with the superconductor layer.

* * * * *